US010374332B2

(12) United States Patent
Chaillet et al.

(10) Patent No.: US 10,374,332 B2
(45) Date of Patent: Aug. 6, 2019

(54) DEVICE FOR HOLDING AND BRINGING INTO ELECTRICAL CONTACT CONDUCTORS

(71) Applicant: ABB SCHWEIZ AG, Baden (CH)

(72) Inventors: Alexandre Chaillet, Lyons (FR); Philippe France, Chazelles sur Lyon (FR)

(73) Assignee: TYCO ELECTRONICS SERVICES GMBH, Schaffhausen (CH)

( * ) Notice: Subject to any disclaimer, the term of this patent is extended or adjusted under 35 U.S.C. 154(b) by 0 days.

(21) Appl. No.: 15/771,729

(22) PCT Filed: Oct. 27, 2015

(86) PCT No.: PCT/EP2015/074851
§ 371 (c)(1),
(2) Date: Apr. 27, 2018

(87) PCT Pub. No.: WO2017/071737
PCT Pub. Date: May 4, 2017

(65) Prior Publication Data

US 2018/0316101 A1 Nov. 1, 2018

(51) Int. Cl.
*H01R 13/15* (2006.01)
*H01R 4/48* (2006.01)
*H01R 9/26* (2006.01)

(52) U.S. Cl.
CPC ..... *H01R 4/4827* (2013.01); *H01R 4/4818* (2013.01); *H01R 9/2616* (2013.01); *H01R 4/4845* (2013.01)

(58) Field of Classification Search
CPC ..... H01R 4/4827; H01R 9/2616
USPC ..... 439/834, 835, 839
See application file for complete search history.

(56) References Cited

U.S. PATENT DOCUMENTS

| | | | |
|---|---|---|---|
| 2004/0014353 | A1 | 1/2004 | Feye-Hohmann |
| 2007/0178747 | A1 | 8/2007 | Schrader |
| 2007/0259574 | A1 | 11/2007 | Kirstein et al. |
| 2014/0127932 | A1 | 5/2014 | Hoppmann et al. |

FOREIGN PATENT DOCUMENTS

| | | | |
|---|---|---|---|
| DE | 102011115637 | A1 | 12/2012 |
| EP | 1816706 | A1 | 8/2007 |
| FR | 2965117 | A1 | 3/2012 |

OTHER PUBLICATIONS

English Machine Translation FR2965117.
International Search Report for Application No. PCT/EP2015/074851.
Written Opinion for Application No. PCT/EP2015/074851.

*Primary Examiner* — Khiem M Nguyen
(74) *Attorney, Agent, or Firm* — Cantor Colburn LLP

(57) ABSTRACT

The invention relates to a device for holding in position and placing in electrical contact (5) for a connection terminal of an electrical apparatus (1), arranged to hold in position and place in electrical contact at least two electrical conductors (7*a*, 7*b*), the device (5) comprising: a first retaining element (9*a*) having a first engagement portion (19*a*) arranged to engage, in a retailing position, with a first electrical conductor (7*a*); a second retaining element (9*b*) having a second engagement portion (19*b*) arranged to engage, in a retaining position, with a second electrical conductor (7*b*); and a clamping point (23) defined at least partially in the retaining position by the first engagement portion (19*a*) and the second engagement portion (19*b*).

17 Claims, 8 Drawing Sheets

DEVICE FOR HOLDING AND BRINGING INTO ELECTRICAL CONTACT CONDUCTORS

CROSS REFERENCE TO RELATED APPLICATIONS

This application is a National Stage of PCT Application No. PCT/EP2015/074851 filed on Oct. 27, 2015, the contents of which is incorporated herein by reference thereto.

TECHNICAL FIELD

The present invention concerns a device for holding in position and bringing into electrical contact at least two electrical conductors.

BACKGROUND

It is known to use electrical apparatuses such as junction blocks or terminal blocks to bring into electrical contact and hold in position two conductors. For this purpose, a junction block may comprise a conductive bar against which the two conductors are held in position.

The conductors may be held in contact position with the conductive bar by using one retaining element per conductor such as for example a leaf spring. Thus, the conductors are disposed away from each other and each is held in position against the bar.

This arrangement is satisfactory in that each conductor can be set in position and removed from the junction block independently.

Nonetheless, the fact of using on the one hand a conductive bar extending according to a longitudinal direction and on the other hand two distant retaining elements arranged to hold the conductors away from each other according to the longitudinal direction, imposes some constraints in terms of construction.

In particular, the length of the bar according to the longitudinal direction imposes the longitudinal dimension of the junction block which thus cannot be reduced for gaining space. In these conditions, it seems to be difficult to reduce the bulk of such junction blocks.

BRIEF SUMMARY

The present invention aims at solving all or part of the above-mentioned drawbacks.

To this end, the present invention concerns a device for holding in position and bringing into electrical contact for a connection terminal of an electrical apparatus arranged to hold in position and bring into electrical contact at least two electrical conductors and arranged to cooperate with an insulating body and/or a connecting bar of said electrical apparatus, the device comprising:

- a first retaining element presenting a first cooperating portion arranged to cooperate, in a retaining position, with a first electrical conductor extending according to a longitudinal direction by imparting a first transverse stress onto said first electrical conductor,
- a second retaining element presenting a second cooperating portion arranged to cooperate, in a retaining position, with a second electrical conductor extending according to the longitudinal direction by imparting a second transverse stress onto said second electrical conductor,

- a clamping location defined at least partially in the retaining position by the first cooperating portion and the second cooperating portion.

This arrangement allows catching the first conductor and the second conductor in the retaining position. The first conductor and the second conductor appear to be disposed between the first retaining element and the second retaining element in the clamping location.

According to an aspect of the invention, the clamping location is intended to bring into electrical contact the first conductor and the second conductor.

Hence, this arrangement allows designing a compact junction block, two conductors may be disposed in the proximity of each other and not at two distant locations.

According to an aspect of the invention, the device for holding in position and bringing into electrical contact comprises an element for connecting the first retaining element and the second retaining element, the connecting element comprising a first flexible connecting portion cooperating with the first retaining element and/or a second flexible connecting portion cooperating with the second retaining element.

This arrangement enables the movability of the first retaining element and of the second retaining element relative to the connecting element. The first retaining element and the second retaining element are also movable independently.

According to an aspect of the invention, the first retaining element and/or the second retaining element are arranged, in the retracted position, for the insertion of the first electrical conductor and/or the second electrical conductor into the clamping location.

According to an aspect of the invention, the first retaining element and the second retaining element are arranged to cooperate with the connecting element so as to be subjected to a stress bringing them close to the retaining position.

Thus, for the insertion of the first and/or second conductor, a user has to impart a stress onto the first retaining element and/or the second retaining element to displace it toward the retracted position.

Subsequently to the insertion of the first and/or second conductor into the clamping location, the first retaining element and the second retaining element will then take on the retaining position when the user no longer imparts any stress thereon.

According to an aspect of the invention, the connecting element comprises a first bearing portion and/or a second bearing portion, attached respectively to the first flexible connecting portion and/or the second flexible connecting portion, each of the bearing portions being arranged to cooperate with the insulating body and/or a connecting bar of the electrical apparatus.

The bearing portions are arranged to cooperate with the insulating body so that a user could displace a retaining element toward the retracted position by imparting a stress onto this retaining element.

The corresponding bearing portion then cooperates with the insulating body and the retaining element is displaced relative to the connecting element.

According to an aspect of the invention, the first retaining element, the first flexible connecting portion and the first bearing portion constitute a first leaf spring, and/or the second retaining element, the second flexible connecting portion and the second bearing portion constitute a second leaf spring.

According to an aspect of the invention, each retaining element corresponds to a clamping tab, each bearing portion to a bearing tab and each flexible connecting portion to an elbow.

Thus, the device for holding in position and bringing into electrical contact is like a double leaf spring, that is to say like a device having two independent leaf springs, said device being arranged for holding the electrical conductors.

According to an aspect of the invention, the connecting element comprises a central connecting portion adjacent to the first bearing portion and to the second bearing portion.

Thus, the central connecting portion should be considered as a part to which each leaf spring is connected. Preferably, the central connecting portion is in the form of an elbow. In particular, the central connecting portion is flexible.

This arrangement confers the device for holding in position and bringing into electrical contact with some flexibility which is advantageous to independently handle the first retaining element or the second retaining element.

According to an aspect of the invention, the first retaining element, the second retaining element and the connecting element are integrally made in one piece.

According to an aspect of the invention, each of the first connecting portion and/or the second connecting portion is in the form of an elbow. Preferably, each of the first bearing portion and/or the second bearing portion has a substantially rectilinear shape.

According to an aspect of the invention, the first bearing portion and the second bearing portion extend in a divergent manner from the central connecting portion.

Preferably, the first retaining element and the second retaining element extend in a convergent manner toward the clamping location.

According to an aspect of the invention, the device for holding in position and bringing into electrical contact is symmetrical with respect to a first plane separating the section of the retaining elements and the connecting element in halves.

Preferably, the device for holding in position and bringing into electrical contact is symmetrical according to a second plane or alternatively with respect to a central point, so that the first retaining element is symmetrical to the second retaining element.

According to an aspect of the invention, the first cooperating portion and/or the second cooperating portion presents a concave location for receiving a portion of the corresponding electrical conductor extending according to the longitudinal direction in the retaining position.

Thus, the concave receiving location allows centering the corresponding conductor. The purpose is to perform a guidance of the conductor, which allows bringing the first electrical conductor and the second electrical conductor into electrical contact in an optimum manner.

According to an aspect of the invention, the first cooperating portion and/or the second cooperating portion correspond to a projection of the corresponding retaining element, forming a transverse edge extending transversely to the longitudinal direction in the retaining position.

The fact of providing a transverse edge extending transversely to the longitudinal direction enables an optimum blocking of the electrical conductor in the retaining position.

Any longitudinal displacement of the electrical conductor is impossible because of the transverse stress caused by the matter protrusion constituted by the projection.

According to an aspect of the invention, the projection corresponds to a partial cutout in the corresponding retaining element and a shift of said partial cutout with respect to the corresponding retaining element.

This arrangement enables matter savings and easiness of manufacture because the projection originates from the same base part as the rest of the retaining element.

This arrangement also allows obtaining a good cohesion between the projection and the rest of the retaining element since the projection and the rest of the retaining element are integrally made in one piece.

According to an aspect of the invention, at least one retaining element presents a displacement portion arranged to cooperate with a displacement element imparting a stress according to the longitudinal direction or a direction oblique with respect to the longitudinal direction, said stress imparted by the displacement tool tending to displace said retaining element out from the clamping location.

Hence, this arrangement allows connecting and removing a conductor easily from the clamping location by biasing the corresponding displacement portion.

According to an aspect of the invention, the displacement portion of the retaining element is adjacent to the cooperating portion of said retaining element. Preferably, the displacement portion extends transversely to the longitudinal direction.

Thus, it is possible to bias the displacement portion by imparting a stress according to a substantially longitudinal direction.

According to an aspect of the invention, the device for holding in position and bringing into electrical contact presents a location intended to an intermediate conductive part arranged to cooperate with the first electrical conductor and the second electrical conductor in the retaining position.

Thus, the two conductors can be brought into electrical contact through an indirect cooperation by disposing the intermediate conductive part between the two conductors.

According to an aspect of the invention, the device for holding in position and bringing into electrical contact presents a fastening location intended to the intermediate conductive part.

Preferably, the fastening location is formed in the central connecting portion. According to an aspect of the invention, the device for holding in position and bringing into electrical contact comprises an intermediate conductive part, in particular the intermediate conductive part presents two contact locations, each being arranged to be in contact with the corresponding electrical conductor, the contact locations being formed on two opposite outer surfaces of the intermediate conductive part extending according to the direction of extension of the intermediate conductive part.

This arrangement allows limiting the thickness of the intermediate conductive part, the thickness having to be considered transversely to the direction of extension of the intermediate conductive part.

Thus, the reduction of the thickness allows bringing the two electrical conductors close to each other and therefore achieving a gain of size and material.

The fact that the current passage section is defined according to the plane of extension of the intermediate conductive part is also advantageous. While having a small thickness, the same passage section of the current circulating between the two electrical conductors may be kept.

Comparatively, according to the state of the art, two electrical conductors are brought into electrical contact via a bar having a current circulation section transverse to the main direction of extension of said bar. In this case, reducing the thickness, that is to say the dimension transverse to the direction of extension of the bar results in reducing the current passage section.

According to an aspect of the invention, the intermediate conductive part comprises copper.

Preferably, the intermediate conductive part extends according to the second plane, that is to say the plane defining the symmetry of the first retaining element with the second retaining element.

According to an aspect of the invention, the device for holding in position and bringing into electrical contact comprises a plurality of corresponding first retaining elements and second retaining elements.

According to an aspect of the invention, each retaining element bearing portion is attached onto the central portion. Preferably, the central portion extends according to a direction of alignment of pairs of first retaining elements and second retaining elements.

The present invention also concerns a set for holding in position and bringing into electrical contact comprising a connecting bar and at least one device for holding in position and bringing into electrical contact as previously described, the intermediate conductive part of said device corresponding to a portion of the connecting bar or a part attached onto said connecting bar. For example, the connecting bar consists of a connecting bar of an electrical apparatus such as a junction block.

Thus, it is possible to bring into electrical contact two electrical conductors located in the clamping location via a portion of the connecting bar used as an intermediate conductive part.

These electrical conductors are also held in position independently of each other since the bar is fixed. These electrical conductors can be brought into electrical contact with other electrical conductors which, in turn, are in contact with another portion of the connecting bar.

According to an aspect of the invention, the connecting bar and the device are arranged to cooperate so that the connecting element of the device is fixed relative to the connecting bar.

The present invention also concerns an electrical apparatus, provided with a connection terminal and comprising a device for holding in position and bringing into electrical contact and/or a set for holding in position and bringing into electrical contact as previously described.

According to an aspect of the invention, the electrical apparatus presents for each retaining element a cooperating surface intended to cooperate with the corresponding bearing portion.

BRIEF DESCRIPTION OF THE DRAWINGS

Anyway, the invention will be better understood using the following description with reference to the appended schematic drawings representing, as a non-limiting example, an embodiment of this device for holding in position and bringing into electrical contact.

DETAILED DESCRIPTION

Figure 5:
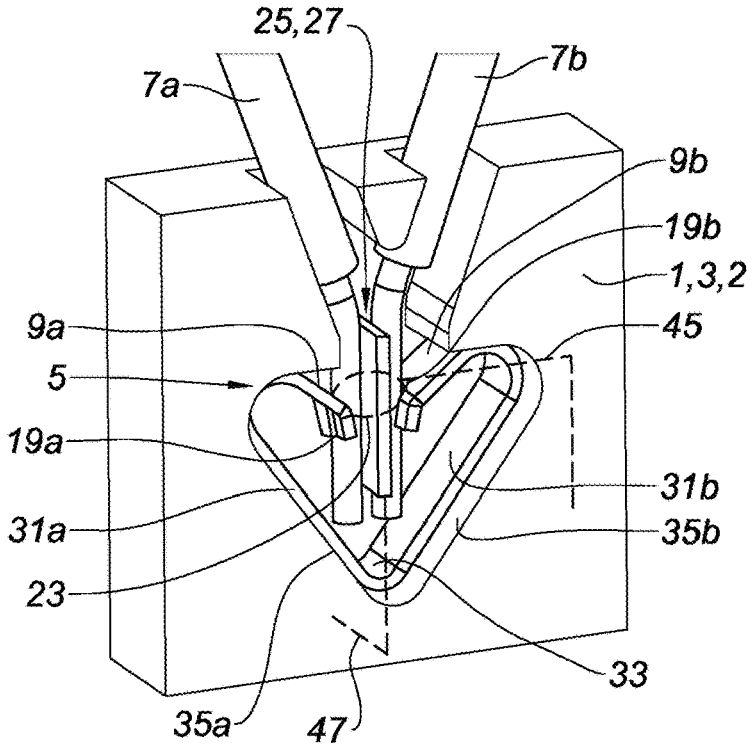
FIG. 5 is a schematic perspective view of a junction block comprising a device for holding in position and bringing into electrical contact two conductors.

As illustrated in FIG. 5, an electrical apparatus 1, in particular a junction block 2 comprises an insulating body 3 and a device 5 for holding in position and bringing into electrical contact a first electrical conductor 7*a* and a second electrical conductor 7*b*.

As also illustrated in FIGS. 1 to 4, the device 5 for holding in position and bringing into electrical contact comprises a first retaining element 9*a*, a second retaining element 9*b* and a connecting element 11.

The connecting element 11 comprises a first flexible portion 13*a* and a second flexible portion 13*b*, each adjacent and secured respectively to the first retaining element 9*a* and to the second retaining element 9*b*.

Figure 3:
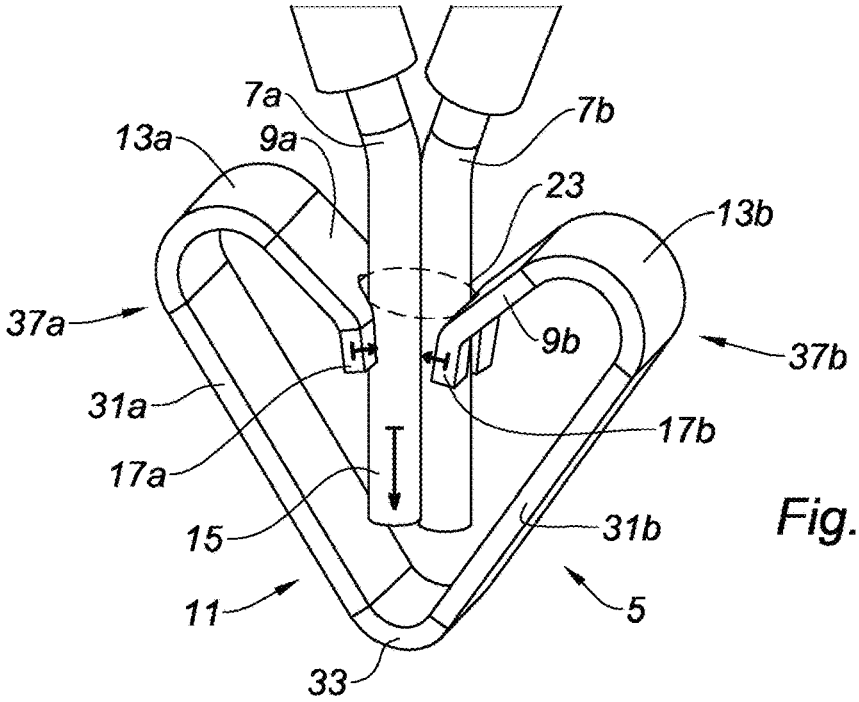
FIG. 3 is a perspective view of said device and two conductors in the retaining position.
Figure 4:
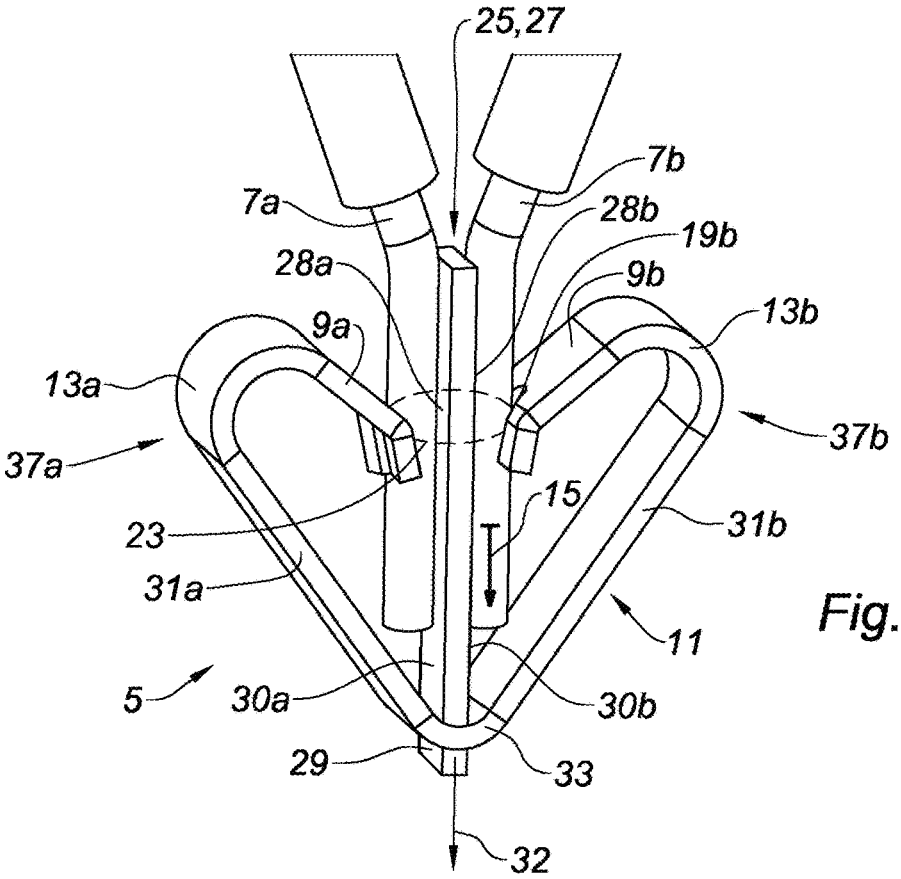
FIG. 4 is a perspective view of said device in the retaining position comprising an intermediate conductive part disposed between the two conductors.

This flexibility enables the independent displacement of each retaining element 9*a*, 9*b* relative to the connecting element 11. In FIGS. 3 to 5, each retaining element 9*a*, 9*b* is disposed at a retaining position in which the corresponding electrical conductor 7*a*, 7*b* extending according to a longitudinal direction 15 is held in position by imparting respectively a first transverse stress 17*a* and a second transverse stress 17*b*.

The transverse stress 17*a*, 17*b* is imparted by the retaining element 9*a*, 9*b* onto the corresponding electrical conductor 7*a*, 7*b*. For this purpose, the first retaining element 9*a* has a first portion 19*a* for cooperating with the first electrical conductor 7*a*, the first cooperating portion 19*a* presenting a first concave receiving location 21*a* extending according to the longitudinal direction 15 in the retaining position.

Similarly, the second retaining element 9*b* comprises a second cooperating portion 19*b* presenting a second concave receiving location 21*b*.

Each flexible connecting portion 13*a*, 13*b* is arranged to subject the corresponding retaining element 9*a*, 9*b*, in the absence of any external bias, to a stress tending to dispose it in the retaining position.

Nonetheless, a displacement of a retaining element 9*a*, 9*b* toward a retracted position may be carried out in order to enable the insertion of the corresponding electrical conductor 7*a*, 7*b* into the junction block 2.

As illustrated more particularly in FIGS. 3 to 5, when the first retaining element 9*a* and the second retaining element 9*b* are in the retaining position, the device 5 for holding in position and bringing into electrical contact presents a clamping location 23.

The clamping location 23 is defined at least partially by the first cooperating portion 19*a* and the second cooperating portion 19*b*. The two electrical conductors 7*a*, 7*b* in electrical contact are comprised within the clamping location 23.

The electrical contact with the first electrical conductor 7*a* in the retaining position is ensured either through a direct contact as illustrated in FIG. 3 or through an indirect contact as illustrated in FIGS. 4 and 5.

In the case of an indirect contact, the device 5 presents, in the retaining position, a location 25 intended to an intermediate conductive part 27 which is in contact with the first electrical conductor 7*a* and the second electrical conductor 7*b*.

As illustrated in FIG. 3, the device 5 for holding in position and bringing into electrical contact may present a location 29 for fastening the intermediate conductive part 27 formed in the connecting element 11.

Alternatively, as illustrated in FIG. 5, the intermediate conductive part 27 may be held in position by another inner element of the junction block 2.

The intermediate conductive part 27 should be considered as being comprised within the device 5 for holding in position and bringing into electrical contact.

As illustrated in FIGS. 4 and 5, the intermediate conductive part presents a first contact location 28*a* and a second contact location 28*b* arranged respectively so as to be in contact with the first electrical conductor 7*a* and the second electrical conductor 7*b*.

The contact locations 28*a*, 28*b*, are formed in opposite outer surfaces 30*a*, 30*b* extending according to a direction of extension 32 of the intermediate conductive part 27.

Thus, the current passage section between the first electrical conductor 7*a* and the second electrical conductor 7*b* through the intermediate conductive part 27 does not depend on its thickness.

Thus, the intermediate conductive part 27 may have a small thickness in comparison with the dimension of the opposite outer surfaces 30*a*, 30*b*.

Figure 1:
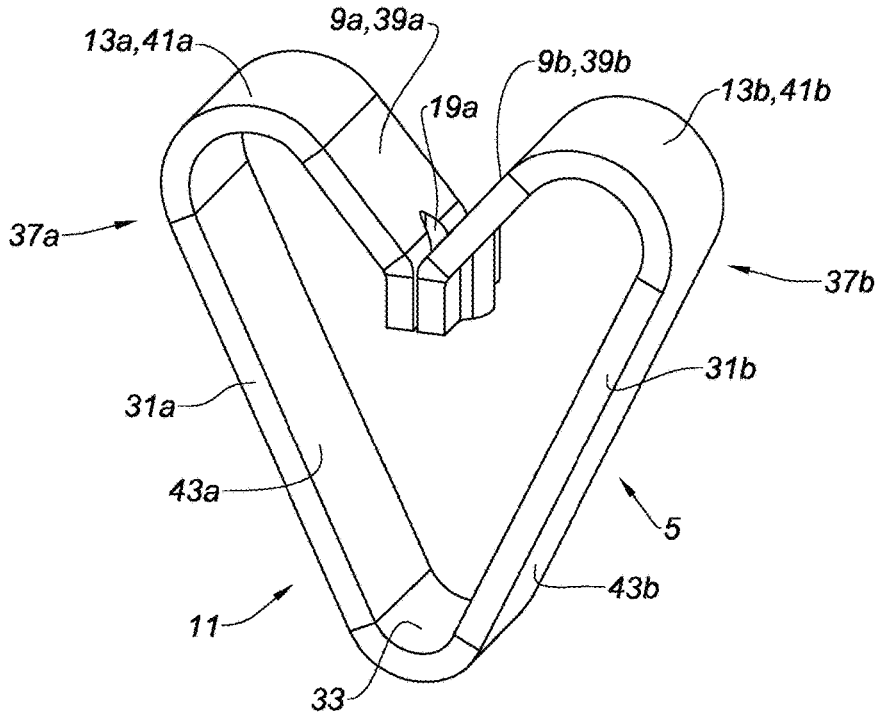
FIGS. 1 and 2 are perspective views of a device for holding in position and bringing into electrical contact two conductors.
Figure 2:
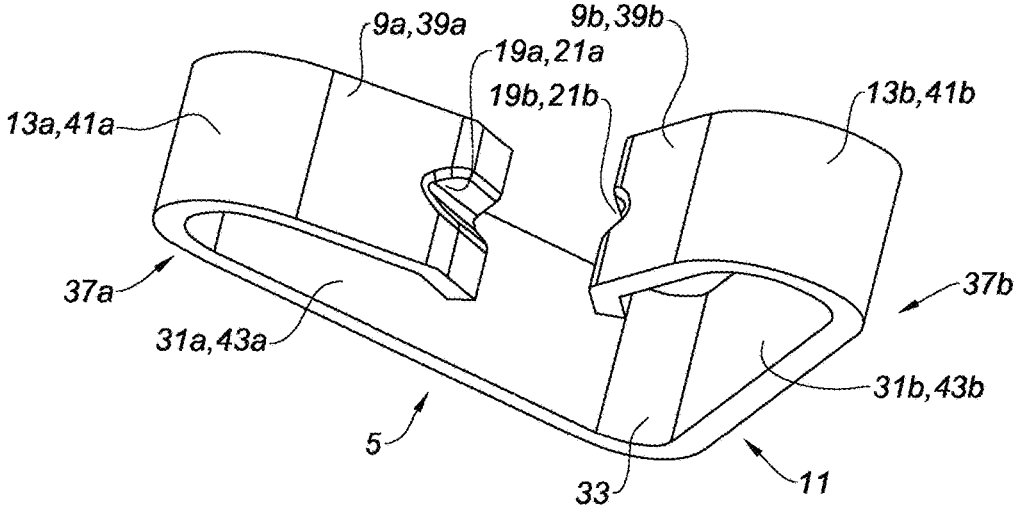

As illustrated more particularly in FIGS. 1, 2 and 5, the connecting element 11 comprises a first bearing portion 31*a*, a second bearing portion 31*b* and a central connecting portion 33 which is adjacent to the first bearing portion 31*a* and to the second bearing portion 31*b*.

The central connecting portion 33 is in the form of an elbow and may be flexible. As illustrated in FIG. 5, the insulating body 3 presents for each retaining element 9*a*, 9*b*, a cooperating surface 35*a*, 35*b* intended to cooperate with the corresponding bearing portion 31*a*, 31*b*. Thus, a first cooperating surface 31*a* and a second cooperating surface 31*b* can be distinguished.

The first retaining element 9*a*, the first flexible connecting portion 13*a* and the first bearing portion 31*a* constitute a first leaf spring 37*a*. The same applies to the second retaining element 9*b*, the second flexible connecting portion 13*b* and the second bearing portion 31*b* which constitute a second leaf spring 37*b*.

Thus, each retaining element 9*a*, 9*b* corresponds to a clamping tab 39*a*, 39*b*, each flexible connecting portion 13*a*, 13*b* to an elbow 41*a*, 41*b* and each bearing portion 31*a*, 31*b* to a bearing tab 43*a*, 43*b*.

As illustrated in FIG. 5, the device 5 for holding in position and bringing into electrical contact appears to be symmetrical according to a first plane 45 which separates in halves the section of the leaf springs 37*a*, 37*b* and according to a second plane 47 which defines the symmetry between the first retaining element 9*a* and the second retaining element 9*b*.

These two symmetries enable a balance of stresses between the first retaining element 9*a* and the second retaining element 9*b*. This arrangement is interesting because the contact between the first and the second electrical conductor 7*a*, 7*b* is thereby held in an optimum manner.

Alternatively and as illustrated in FIGS. 16 to 21, the symmetry between the first retaining element 9*a* and the second retaining element 9*b* is defined with respect to a central point 47'. This central symmetry also enables a balanced distribution of forces in the retaining position.

Figure 6:
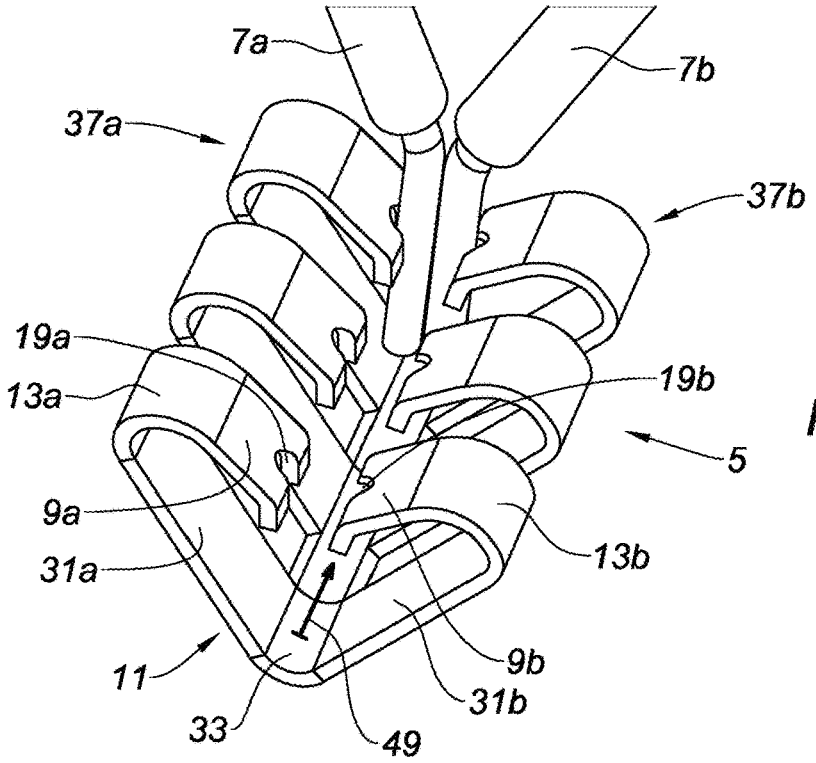
FIGS. 6 to 8 are perspective views of a device for holding in position and bringing into electrical contact a plurality of pairs of conductors.
Figure 7:
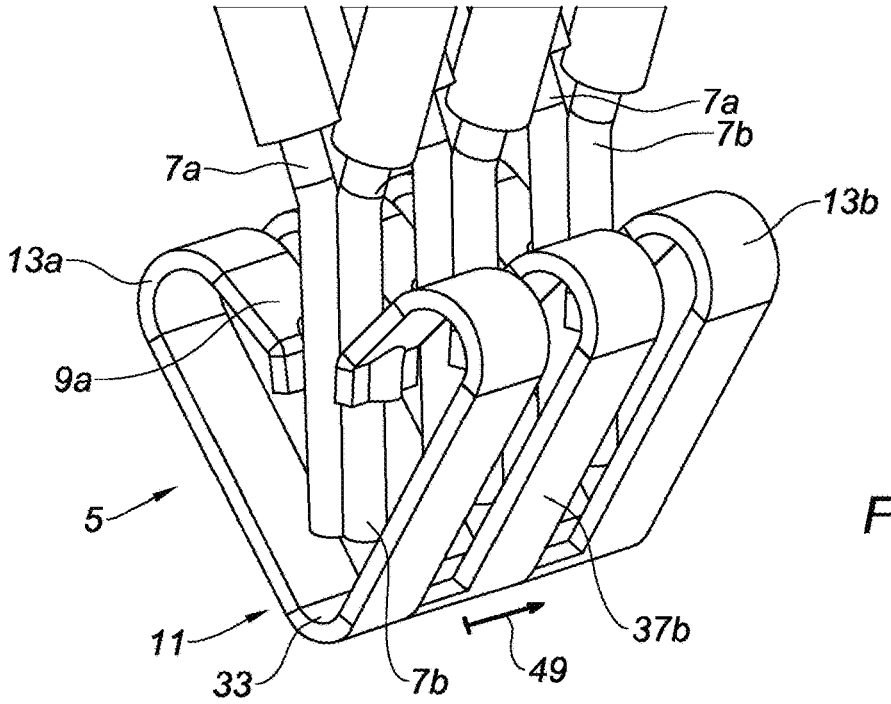
Figure 8:
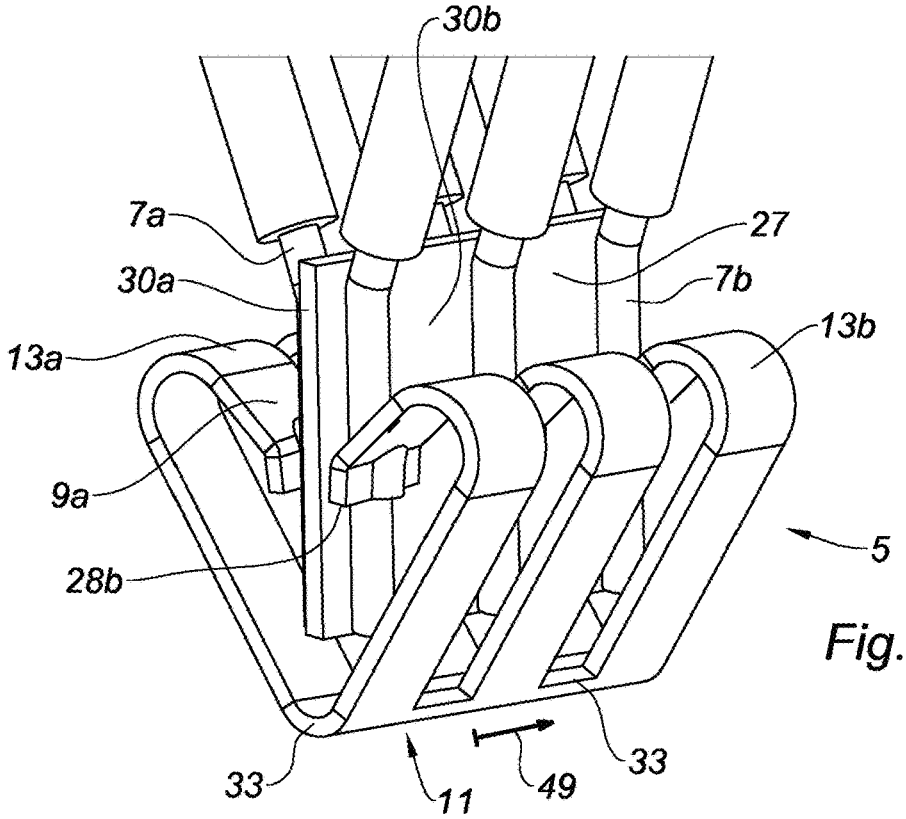

In FIGS. 6 to 8 is shown a variant according to which the device 5 for holding in position and bringing into electrical contact comprises several pairs of first and second retaining elements 9*a*, 9*b* disposed according to a direction of alignment 49.

According to this variant, the central connecting portion 33 extends according to the direction of alignment 49 and is connected to each retaining element 9*a*, 9*b*.

The electrical conductors 7*a*, 7*b* may be in electrical contact together as illustrated in FIG. 8 by disposing a common intermediate conductive part 27 or still connected in pairs as in FIG. 7.

A variant is presented in FIGS. 9 to 15. According to this variant, the electrical apparatus 1 is a junction block 2. Each device 5 for holding in position and bringing into electrical contact allows connecting two electrical conductors 7*a*, 7*b* to a connecting bar 51 of the junction block 2.

Thus, the connecting bar 51 may be connected to a total number of four electrical conductors 7*a*, 7*b*. Each electrical conductor 7*a*, 7*b* can be independently connected because, when in the retaining position, each electrical conductor 7*a*, 7*b* is held in position against the connecting bar 51 by the corresponding retaining element 9*a*, 9*b* which can be displaced independently.

The connecting bar 51 comprises a central portion 51*a* and two lateral portions 51*b*. Each lateral portion 51*b* consists of an intermediate conductive part 27 as previously described.

Figure 9:
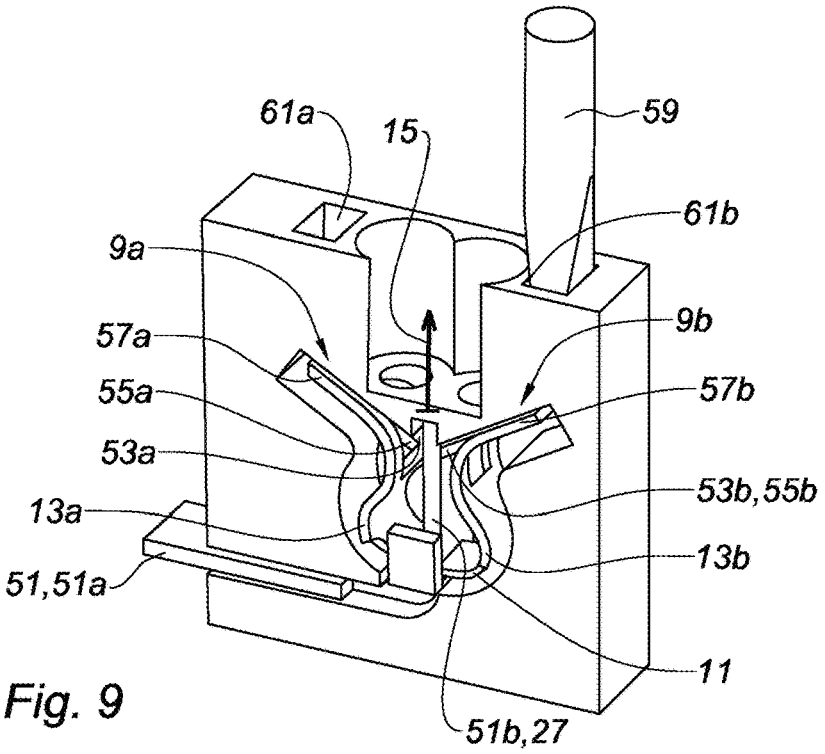
FIG. 9 is a perspective view of a set for holding in position and bringing into electrical contact comprising a connecting bar and a device for holding in position and bringing into electrical contact.
Figure 10:
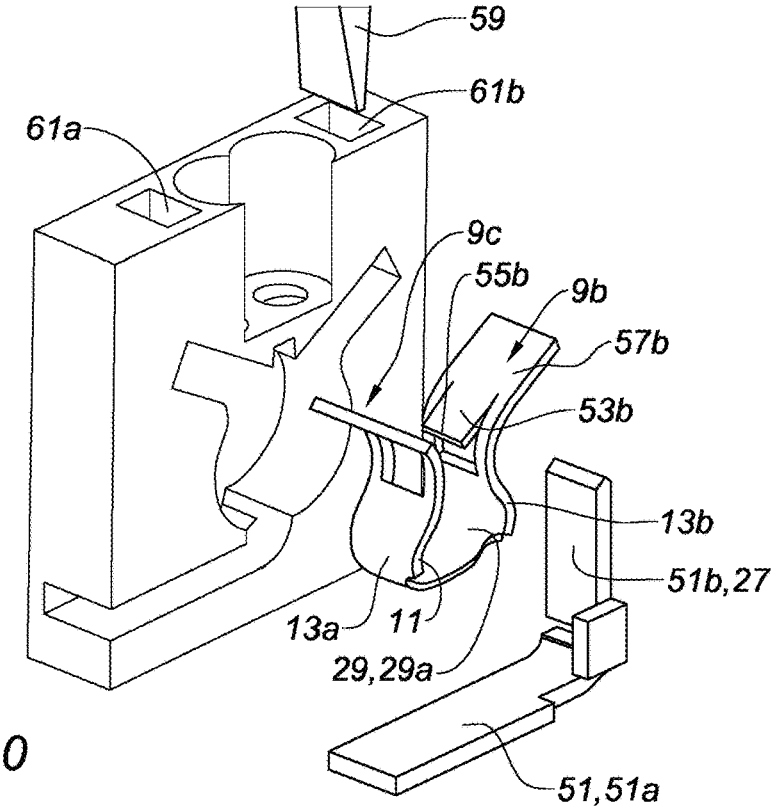
FIG. 10 is an exploded view of the elements of FIG. 9.
Figure 11:
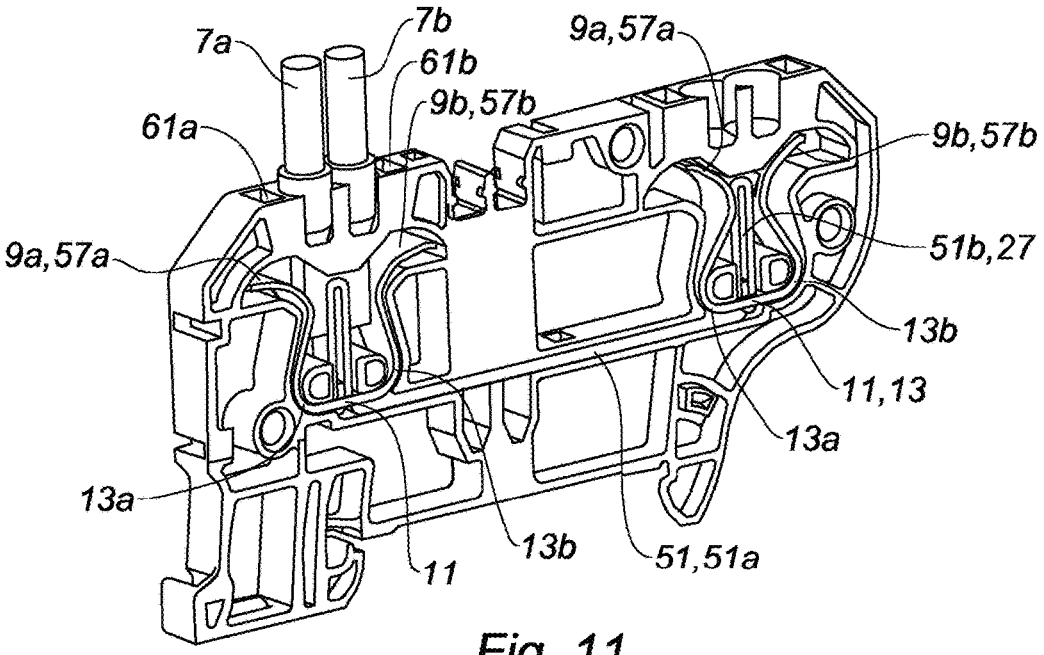
FIGS. 11 to 13 are perspective and front views of a junction block comprising a set for holding in position and bringing into electrical contact.

Hence, each lateral portion 51*b* presents two locations 28*a*, 28*b* for contact with the corresponding electrical conductors 7*a*, 7*b* and the device 5 presents a fastening location 29 which is either a rib 29*a* as in FIGS. 9 and 10 or a notch 29*b* as in FIGS. 11 to 14.

As shown more particularly in FIG. 10, each retaining element 9*a*, 9*b* presents a matter protrusion or projection 53*a*, 53*b* which corresponds to the cooperating portion 19*a*, 19*b*.

This projection 53*a*, 53*b* is transverse to the longitudinal direction 15 in the retaining position and forms a transverse edge of the retaining portion 9*a*, 9*b*. The projection 53*a*, 53*b* corresponds to a partial cutout 55*a*, 55*b* in the retaining element 9*a*, 9*b* and a shift of said partial cutout 55*a*, 55*b* with respect to the corresponding retaining element 9*a*, 9*b*.

The retaining element 9*a*, 9*b* further comprises a displacement portion 57*a*, 57*b* arranged to cooperate with a displacement element 59 such as a screwdriver inserted into a corresponding channel 61*a*, 61*b* of the junction block 2.

Figure 12:
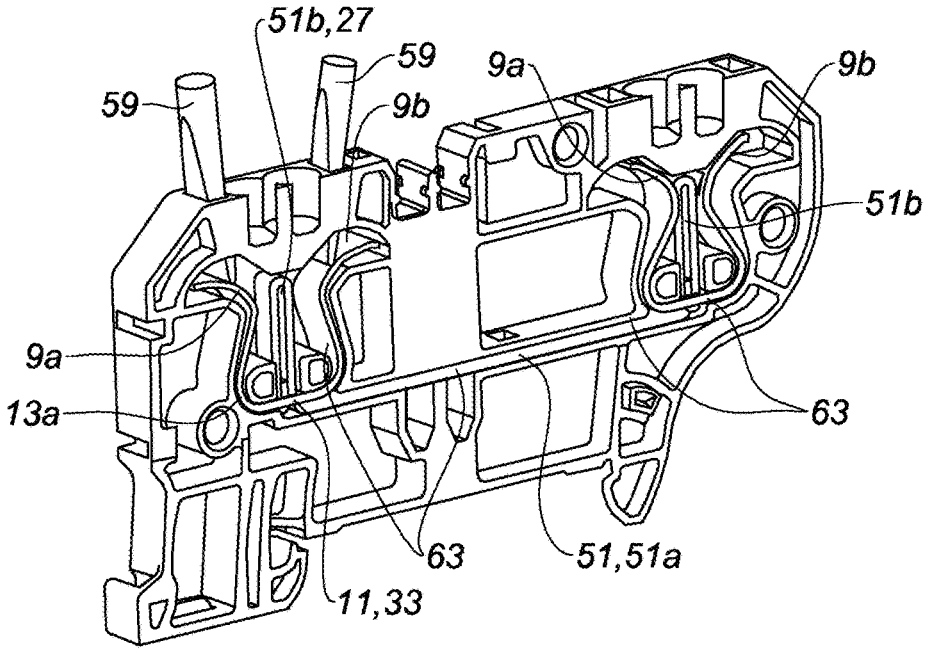
Figure 13:
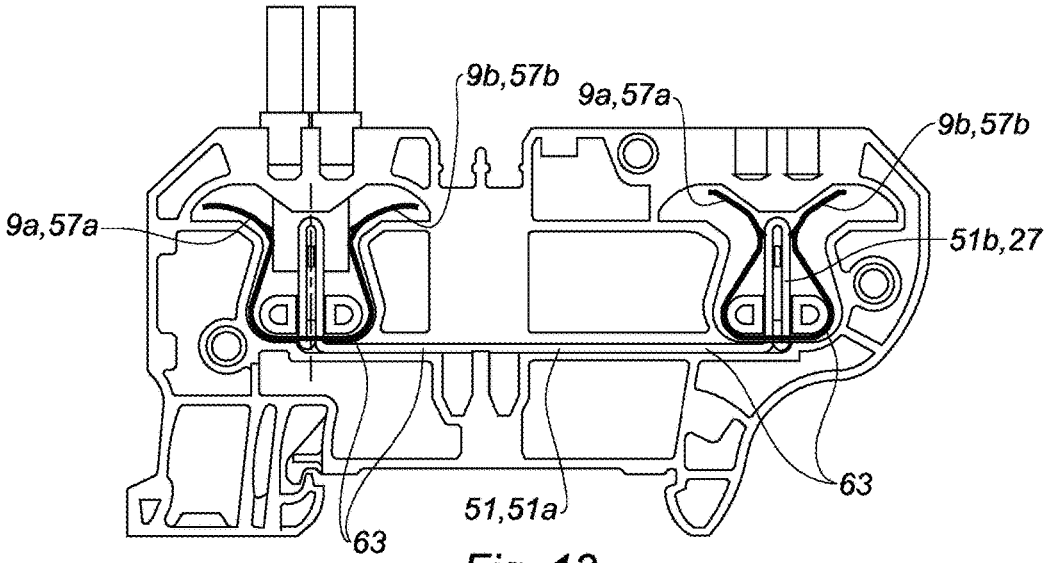
Figure 14:
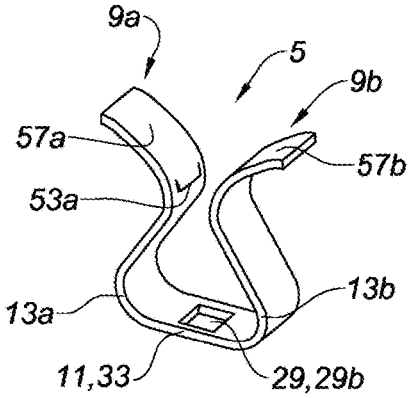
FIG. 14 is a perspective view of a device for holding in position and bringing into electrical contact corresponding to the junction block of FIGS. 11 to 13.
Figure 15:
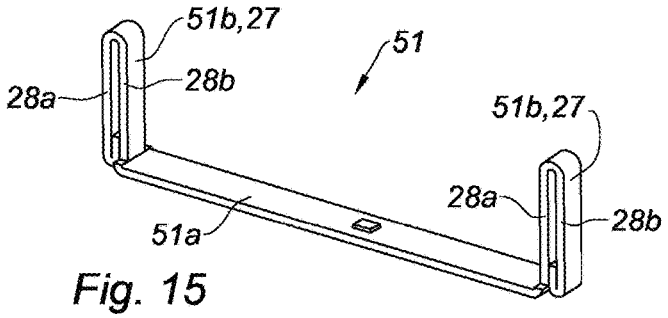
FIG. 15 is a perspective view of a connecting bar corresponding to the junction block of FIGS. 11 to 13.
Figure 16:
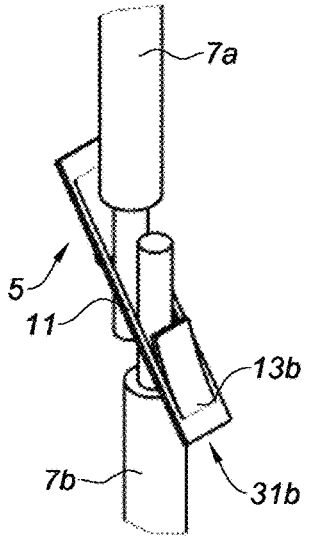
FIGS. 16 to 21 are perspective or front views of variants of the device in the retaining position.
Figure 17:
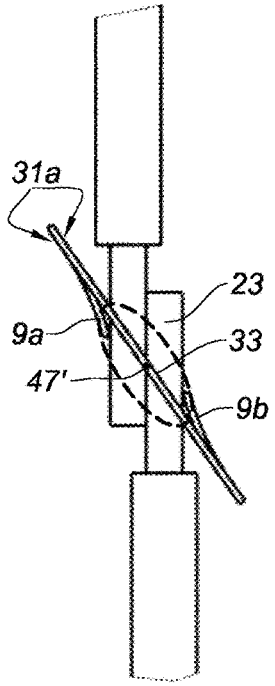
Figure 18:
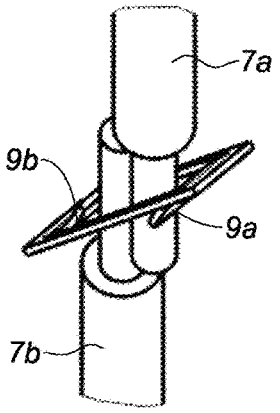
Figure 19:
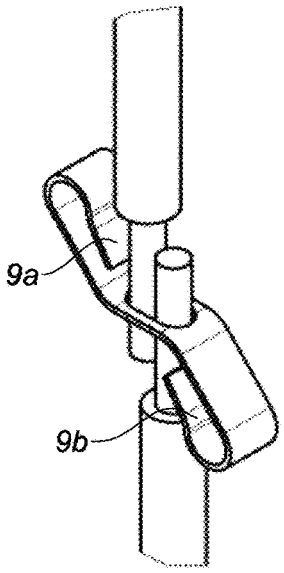
Figure 20:
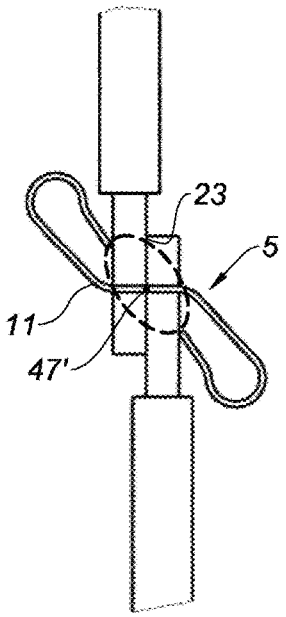
Figure 21:
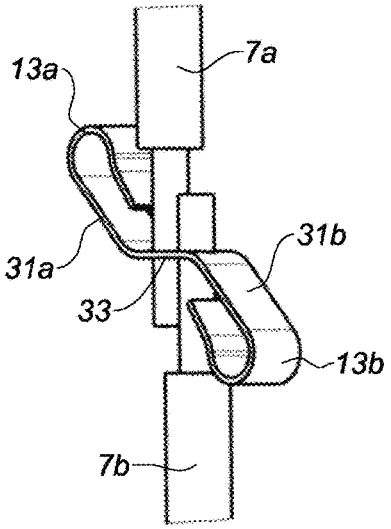

As illustrated in FIG. 12, the displacement element 59 imparts onto the retaining element 9*a*, 9*b* a stress according to the longitudinal direction 15 or a direction oblique with respect to the longitudinal direction 15. This stress tends to displace the retaining element 9*a*, 9*b* out from the clamping location 23 for the introduction or the removal of the corresponding conductor 7*a*, 7*b*.

The displacement portion 57*a*, 57*b* is adjacent to the cooperating portion 19*a*, 19*b* and extends transversely to the longitudinal direction 15.

Thus, it is possible to distinguish a set 63 for holding in position and bringing into electrical contact comprising the connecting bar 51 and at least one device 5 as previously described.

Of course, the invention is not limited to sole embodiment of this device for holding in position and bringing into electrical contact, described hereinabove as example, but it encompasses on the contrary all variants thereof.

The invention claimed is:

1. A device for holding in position and bringing into electrical contact for a connection terminal of an electrical apparatus arranged to hold in position and bring into electrical contact at least two electrical conductors and arranged to cooperate with an insulating body and/or a connecting bar of said electrical apparatus, the device comprising:

a first retaining element presenting a first cooperating portion arranged to cooperate, in a retaining position, with a first electrical conductor extending according to a longitudinal direction by imparting a first transverse stress onto said first electrical conductor, a second retaining element presenting a second cooperating portion arranged to cooperate, in a retaining position, with a second electrical conductor extending according to the longitudinal direction by imparting a second transverse stress onto said second electrical conductor, a clamping location defined at least partially in the retaining position by the first cooperating portion and the second cooperating portion;

a connecting bar;

an intermediate conductive part arranged to cooperate with the first electrical conductor and the second electrical conductor in the retaining position; the intermediate conductive part providing two contact locations each being arranged to be in contact with a corresponding electrical conductor of the at least two electrical conductors, the two contact locations being formed on two opposite outer surfaces of the intermediate conductive part, wherein the two opposite outer surfaces extend according to a direction of extension of the intermediate conductive part; and wherein the intermediate conductive part of the device corresponds to a portion of the connecting bar or a part attached onto the connecting bar.

2. The device for holding in position and bringing into electrical contact according to claim 1, comprising a connecting element for connecting the first retaining element and the second retaining element, the connecting element comprising a first flexible connecting portion cooperating with the first retaining element and/or a second flexible connecting portion cooperating with the second retaining element.

3. The device for holding in position and bringing into electrical contact according to claim 2, wherein the connecting element comprises a first bearing portion and/or a second bearing portion, attached respectively to the first flexible connecting portion and/or the second flexible connecting portion, each of the bearing portions being arranged to cooperate with the insulating body and/or a connecting bar of the electrical apparatus.

4. The device for holding in position and bringing into electrical contact according to claim 3, wherein the first retaining element, the first flexible connecting portion and the first bearing portion constitute a first leaf spring, and/or wherein the second retaining element, the second flexible connecting portion and the second bearing portion constitute a second leaf spring.

5. The device for holding in position and bringing into electrical contact according to claim 3, wherein the connecting element comprises a central connecting portion adjacent to the first bearing portion and to the second bearing portion.

6. The device for holding in position and bringing into electrical contact according to claim 1, wherein the first retaining element, the second retaining element and the connecting element are integrally made in one piece.

7. The device for holding in position and bringing into electrical contact according to claim 1, wherein the first cooperating portion and/or the second cooperating portion presents a concave location for receiving a portion of the corresponding electrical conductor extending according to the longitudinal direction in the retaining position.

8. The device for holding in position and bringing into electrical contact according to claim 1, wherein the first cooperating portion and/or the second cooperating portion correspond to a projection of the corresponding retaining element, forming a transverse edge extending transversely to the longitudinal direction in the retaining position.

9. The device for holding in position and bringing into electrical contact according to claim 1, wherein at least one retaining element presents a displacement portion arranged to cooperate with a displacement element imparting a stress according to the longitudinal direction or a direction oblique with respect to the longitudinal direction, said stress imparted by the displacement tool element tending to displace said retaining element out from the clamping location.

10. The device for holding in position and bringing into electrical contact according to claim 1, wherein the device for holding in position and bringing into electrical contact presents a fastening location (29) intended to the intermediate conductive part.

11. An electrical apparatus provided with a connection terminal and comprising a device for holding in position and bringing into electrical contact according to claim 1.

12. The device for holding in position and bringing into electrical contact according to claim 4, wherein the connecting element comprises a central connecting portion adjacent to the first bearing portion and to the second bearing portion.

13. The device for holding in position and bringing into electrical contact according to claim 2, wherein the first retaining element, the second retaining element and the connecting element are integrally made in one piece.

14. The device for holding in position and bringing into electrical contact according to claim 3, wherein the first retaining element, the second retaining element and the connecting element are integrally made in one piece.

15. The device for holding in position and bringing into electrical contact according to claim 2, wherein the first cooperating portion and/or the second cooperating portion presents a concave location for receiving a portion of the corresponding electrical conductor extending according to the longitudinal direction in the retaining position.

16. The device for holding in position and bringing into electrical contact according to claim 3, wherein the first cooperating portion and/or the second cooperating portion presents a concave location for receiving a portion of the corresponding electrical conductor extending according to the longitudinal direction in the retaining position.

17. The device for holding in position and bringing into electrical contact according to claim 2, wherein the first cooperating portion and/or the second cooperating portion correspond to a projection of the corresponding retaining element, forming a transverse edge extending transversely to the longitudinal direction in the retaining position.

* * * * *